United States Patent [19]

Herklotz et al.

[11] 4,354,860

[45] Oct. 19, 1982

[54] METHOD FOR DETERMINING THE FILTER CURRENT LIMIT OF AN ELECTROSTATIC FILTER

[75] Inventors: Helmut Herklotz, Neu Isenburg; Günter Mehler, Frankfurt am Main; Franz Neulinger, Dietzenbach; Helmut Schummer, Heusenstamm; Horst Daar, Erlangen; Walter Schmidt, Uttenreuth; Heinrich Winkler, Neunkirchen, all of Fed. Rep. of Germany

[73] Assignee: Siemens Aktiengesellschaft, Munich, Fed. Rep. of Germany

[21] Appl. No.: 213,620

[22] Filed: Dec. 5, 1980

[30] Foreign Application Priority Data

Dec. 11, 1979 [DE] Fed. Rep. of Germany ..... 2949786

[51] Int. Cl.[3] ..... B03C 3/68

[52] U.S. Cl. ..... 55/105; 323/241; 323/246; 323/903

[58] Field of Search ..... 55/105, 139; 323/237, 323/241, 245, 246, 320, 322, 903; 328/114, 132, 161

[56] References Cited

U.S. PATENT DOCUMENTS

| | | | |
|---|---|---|---|
| 2,907,403 | 10/1959 | Foley | 55/105 |
| 3,893,828 | 7/1975 | Archer | 55/105 X |
| 4,138,232 | 2/1979 | Winkler et al. | 55/105 |

OTHER PUBLICATIONS

Goller et al, "Elektrofiltersteuerung mit direkter Durchbruchserfassung", Siemens-Zeitschrift, 1971, pp. 567-572.

GE Silicon Controlled Rectifier Manual, 1964, Third Edition, pp. 41,42.

*Primary Examiner*—A. D. Pellinen

*Attorney, Agent, or Firm*—Kenyon & Kenyon

[57] ABSTRACT

The automatic recording of the current-voltage characteristic of an electrostatic filter in which the characteristic obtained upon stepwise variation of the control is displayed to the operating personnel and at the same time saturation phenomena and voltage maxima are picked up.

5 Claims, 3 Drawing Figures

METHOD FOR DETERMINING THE FILTER CURRENT LIMIT OF AN ELECTROSTATIC FILTER

BACKGROUND OF THE INVENTION

This invention relates to a method for determining the filter current limit of an electrostatic filter which is fed through a control element from an alternating current source and in which the control voltage of the control element can be varied up to a given filter current limit as a function of filter operating data.

A control method of this general type as described more specifically, for example, in the journal Siemens-Zeitschrift 1971, pp. 567–572.

Since the efficiency of an electrostatic filter increases approximately with the square of the applied voltage, it is desirable to set the filter voltage as high as possible. However, the breakdown strength of the gas sets an upper limit for this voltage. Since, apart from the disruptive discharge itself, there is no criterion for the maximum possible voltage, disruptive discharges must be brought about at certain intervals of time to sample this limit. Since the disruptive discharge limit can change very rapidly, one must sample relatively frequently.

With such a control dependent on disruptive discharge, provision must be made to insure that the current load capacity of the installation is not exceeded. In the known arrangement, an adjustable current limitation prevents further rise of the control voltage when the set value is reached. If the current increases because of a reduction of the dust resistance, the current limitation will bring about a slow falling of the control voltage until the current has dropped to its set value.

Besides this limitation of the nominal current, another type of filter current limitation is also of interest. Under certain operating conditions of an electrostatic filter, e.g. in sintering plants or in by-pass operation in cement mills, either a filter voltage maximum or a filter voltage saturation may occur.

Here the objective of the function "current limitation" is to establish the maximum or respectively the saturation, in order to prevent unnecessarily high filter currents.

SUMMARY OF THE INVENTION

It is the object of the present invention to determine the filter current limit, which is dependent on the operating state of the filter, in such a way that an optimum ratio of separator output to energy consumption results.

According to the present invention, this problem is solved by automatically varying the control voltage in predetermined steps to a minimum and then again to the original value, during the operation of the filter, at given intervals of time, and at the same time continuously calculating the ratios of change of filter voltage to change of control voltage and change of filter voltage to change of filter current and, if the results fall short of given limit values of these ratios, or if there is a sign change of two successive ratio values, using the respective associated filter current to determine the filter current limit.

In this manner, saturation phenomena or respectively maximum values of the filter voltage from which point on a further increase in the energy supply to the filter, i.e., a current increase, no longer results in a substantial improvement of the separator output can be recognized.

Recognition of such limit values is of great interest with a view to economical operation of the electrostatic filter.

Advantageously the filter current limit from which point on further increase of the filter output is prevented is chosen, for instance, so that it is 3 to 15% above the filter current at which the above-mentioned criteria are present.

Advantageously, the filter current and filter voltage values detected at each step are also stored and the filter characteristic determinable therefrom is displayed. For one thing, this will give the operator information about the performance of the filter, and for another, it may be of interest for priority optimization strategies of several filters. In plotting the filter characteristic, it is further advantageous to calculate the ratio of change of filter voltage and change of filter current to change of control voltage. If it appears that the relative change of filter voltage during change of control voltage is greater than the change of the filter current, then a defined voltage reduction is effected at breakdowns of the filter. If the opposite case occurs, a defined current reduction is effected at breakdowns. In this way one can decide whether as a reaction to a disruptive discharge the current or the voltage should expediently be reduced by a given amount, so as to remain, e.g., within the prescribed frequency of disruptive discharges.

Further, when several filters connected in series or in parallel are provided, the times selected for recording the filter characteristic are preferably selected so that the control voltage is varied only in one filter each time. Assuming, for instance, that the filter characteristic is recorded every 15 minutes and recording takes one second each time, it can be seen that this practically does not affect the filtering.

DETAILED DESCRIPTION

Figure 1:
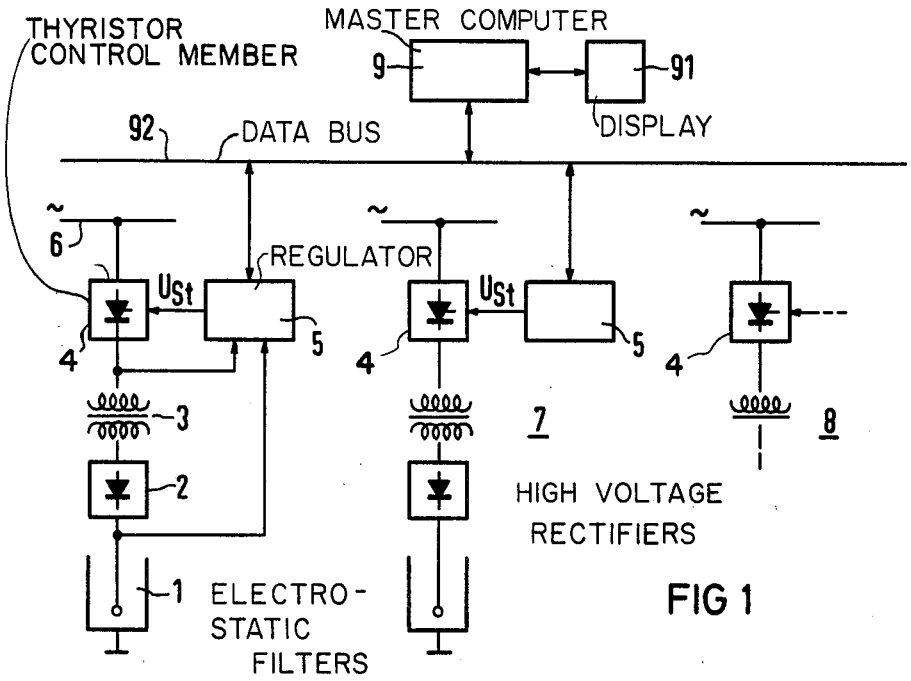
FIG. 1 shows the circuit diagram of a filter installation with control.

In the arrangement shown in FIG. 1, the electrostatic filter 1 is fed from an a-c voltage source 6 via a high voltage rectifier 2, high voltage transformer 3, and a thyristor control element 4 consisting of antiparallel connected thyristors. As a function of filter operating data, such as primary current and primary voltage, secondary voltage, secondary current and the number of breakdowns in the filter, the control voltage $U_{St}$ for the thyristor control element 4 is determined through a regulator 5 so as to result in optimum filter operating data. A control element of this kind is described for example in the initially mentioned article. Following the trend of modern digitization, it is of advantage to design this regulator 5 as a digital regulator, i.e., so that it, essentially comprises a microcomputer system.

Besides the filter just described, additional filters 7 and 8 are indicated. The digital regulators 5 of the various filters communicate via a data bus 92 with a master computer 9, to which a display 91 is assigned. From the master computer 9 the individual operating parameters and control values can be set, and if desired, optimization strategies for the filter can be calculated.

The filter current as a function of the peak voltage or respectively of the arithmetic mean or of the virtual value of the filter voltage will be referred to in the following as a filter characteristic. It depends, among other things, on the instantaneous operating conditions of the electrostatic filter and therefore must be determined cyclically, e.g., at intervals of 15 minutes and at a moment when the breakdown limit is not just being sampled.

In recording the filter characteristic, first the prevailing control voltage $U_{St}$ is stored, and after recording of the filter characteristic is completed this value is again fed to the thyristor control element 4. At the same time the correlated values of filter voltage and filter current are stored. Then, at the beginning of each half wave of the primary voltage, the control voltage is reduced by a constant increment $\Delta U_{St}$ until a minimum value of, e.g., 1 volt is reached. This minimum determined by the lowest possible control voltage. Thereafter the control voltage $U_{St}$ is again run up from this minimum value with the same increments to the prevailing value at the beginning of the recording. Assuming, e.g., that the entire filter characteristic is divided into 32 base points, this being quite sufficient for normal operating conditions, one can figure on a maximum duration of about 0.5 to 1 second for the recording of the filter characteristic.

The values of filter voltage $U_{Fi}$, $U_{F1+1}$ etc. correlated with each control voltage $U_{St}$ and of the filter current $I_F$, are stored during the reduction phase and the arithmetic mean is taken with the corresponding values of the run-up phase. The characteristic calculated therefrom can then be displayed in the display unit 91.

After the initial value of the control voltage has been reached, an examination is made to see whether the filter current limitation must be changed, and the prevailing reversal point between current and voltage reduction at breakdowns is calculated. In this connection, it should also be noted that if a breakdown occurs during recording of the filter characteristic, the normal voltage or current reduction routine intervenes and recording of the characteristic is interrupted, because during the actual breakdown no usable ratios can be calculated.

Figure 2:
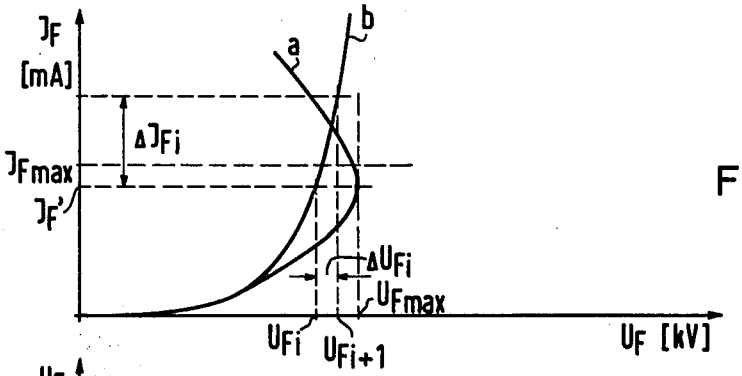
FIG. 2 illustrates two filter characteristics, i.e., dependence on filter voltage and filter current.
Figure 3:
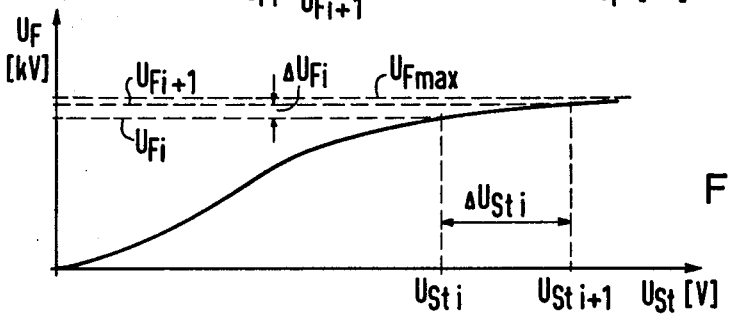
FIG. 3 illustrates the filter voltage as a function of the control voltage at the control element.

In FIG. 2, two filter characteristics, i.e., filter current $I_F$ as a function of the filter voltage $U_V$ are plotted. Curve a shows a filter characteristic with a voltage maximum and curve b a filter characteristic with saturation phenomena. A filter voltage saturation exists when—cf. FIG. 3

$$\Delta U_{Fi}/\Delta I_{Fi} < \text{epsilon or}$$

$$\Delta U_{Fi}/\Delta U_{Sti} < \text{epsilon},$$

$U_{Fi}$, $I_{Fi}$ and $U_{Sti}$ being standard increments of the filter voltage, filter current and control voltage at point i, with $\Delta \leqq i \leqq 32$.

Let us stipulate as a threshold, e.g., epsilon=0.005. Hence, if during the plotting of the filter characteristic, one falls short of this value epsilon, the maximum filter limit current is limited in this case to the value $I_{Fmax}=X\ I'_F$, $I'_F$ being the value at which the respective criterion was established and X being selected between 103 and 115%.

A filter voltage maximum exists when the sign of a filter voltage increment is unlike the sign of the next filter voltage increment at changed control voltage (cf. curve a), that is, the sign of:

$$\Delta U_{Fi+1} \neq \Delta U_{Fi} \text{ with } \Delta U_{Fi+1} = U_{Fi+2} - U_{Fi+1}$$

$$\Delta U_{Fi} = U_{F1+1} - U_{Fi} \text{ or}$$

$$(\Delta U_{Fi+1})/(\Delta U_{Sti+1}) \neq \Delta U_{Fi}/\Delta U_{Sti}$$

i denoting the sampling points of the filter characteristic. Also in this case the maximum filter current is limited to the value $I_{Fmax}=X\ I'_F$.

The maximum filter current and the correlated values of filter and control voltage are stored. They limit, e.g., the adjustment range of a flue gas density control or the sampling of the breakdown limit.

Additionally, the reversal point, i.e., the point beyond which advantageously a defined voltage or current reduction is to be effected at a breakdown, can be established from the record of the filter characteristic. The reversal point assumed as criterion for this option is determined by calculating the ratio of change of filter voltage to change of control voltage and the ratio of change of filter current to change of control voltage, and by comparing these two ratio values. If there results a relatively greater reaction of the filter current than of the filter voltage when the control voltage is changed, one operates a breakdown with a defined current reduction, as this is then more favorable in terms of processing technology. The reverse applies if the relative voltage change is greater than the relative current change when the control voltage is changed.

The computer 9 may be any one of the well known microprocessors presently available such as the motorola 6805, Intel 8080A, Z-Log Z-80 etc. The display 91 can be an conventional CRT display. Software for operating such a display and displaying the information stored graphically, is readily available for all of the above types of microprocessors and thus is not discussed in detail herein.

What is claimed is:

1. In a method for determining the filter current limit of an electrostatic filter which is fed from an alternating current source via a control element and in which the control voltage of the control element can be varied up to a given filter current limit as a function of filter operating data, the improvement comprising, during the operation of the filter, at given intervals of time, varying the control voltage in given steps to a minimum and then again to its original value, while at the same time continuously calculating the ratios of change of filter voltage to change of control voltage and change of filter voltage to change of filter current and, if given limit values of these ratios are not reached, or if there is a sign change of two successive ratio values using the respective associated filter current to determine the filter current limit.

2. The method according to claim 1, comprising establishing the filter current limit at about 3 to 15% above the filter current at which one of the criteria is fulfilled.

3. The method according to claim 1, comprising storing the values of filter current and filter voltage of each step and displaying the resulting filter characteristic.

4. The method according to claim 1, wherein several filters are used comprising choosing the times for recording the filter characteristic so that the control voltage is varied only at one filter each time.

5. The method according to claim 1, comprising calculating the ratio of change of filter voltage and change of filter current to change of the control voltage, and using the respective greater relative value to establish whether as a reaction to the breakdowns of the filter a defined voltage or current variation is to be carried out.

* * * * *